US011459797B2

(12) United States Patent
Delot

(10) Patent No.: US 11,459,797 B2
(45) Date of Patent: Oct. 4, 2022

(54) LATCH MECHANISM FOR A GATE

(71) Applicant: HILL & SMITH LIMITED, Wolverhampton (GB)

(72) Inventor: Jeremy Rene Delot, Wolverhampton (GB)

(73) Assignee: HILL & SMITH LIMITED, Bilston (GB)

( * ) Notice: Subject to any disclaimer, the term of this patent is extended or adjusted under 35 U.S.C. 154(b) by 380 days.

(21) Appl. No.: 16/514,057

(22) Filed: Jul. 17, 2019

(65) Prior Publication Data

US 2020/0024869 A1 Jan. 23, 2020

(30) Foreign Application Priority Data

Jul. 18, 2018 (GB) ..... 1811732

(51) Int. Cl.
*E05B 65/00* (2006.01)
*E01F 13/06* (2006.01)
(Continued)

(52) U.S. Cl.
CPC ..... *E05B 65/0007* (2013.01); *E01F 13/06* (2013.01); *E05C 3/12* (2013.01);
(Continued)

(58) Field of Classification Search
CPC ..... E05B 65/0007; Y10T 292/0863; Y10T 292/0864; Y10T 292/0866;
(Continued)

(56) References Cited

U.S. PATENT DOCUMENTS 960,777 A * 6/1910 Barnwell ..... E05C 17/50 292/121
1,083,455 A * 1/1914 Mohn ..... E05C 1/04 292/57
(Continued)

FOREIGN PATENT DOCUMENTS

DE 29807572 U1 * 7/1998 ..... E05C 17/48
FR 2667344 A1 * 4/1992 ..... E05C 17/50
(Continued)

OTHER PUBLICATIONS

United Kingdom Patent Office, Search Report for priority application GB 1811732.5, dated Jan. 10, 2019.
(Continued)

*Primary Examiner* — Carlos Lugo
(74) *Attorney, Agent, or Firm* — Gottlieb, Rackman & Reisman, P.C.

(57) ABSTRACT

A latch mechanism for a gate has a main support, first and second retention members, and a rotatable latch. The retention members each have a respective key aperture and the respective first and second apertures are spaced along the main support and separated by a gap. The rotatable latch includes a latch portion, one or more key portions which extend through either or both of the first key aperture and second key aperture, and is rotatable about an axis of rotation between a receiving position in which the gate is moveable between an open position and a closed position, or vice versa, and a latched position in which the gate is restrained in the closed position by the latch portion and where the one or more key portions engage with either or both of the first and second retention members to prevent withdrawal of the rotatable latch.

22 Claims, 4 Drawing Sheets

Figure 1:
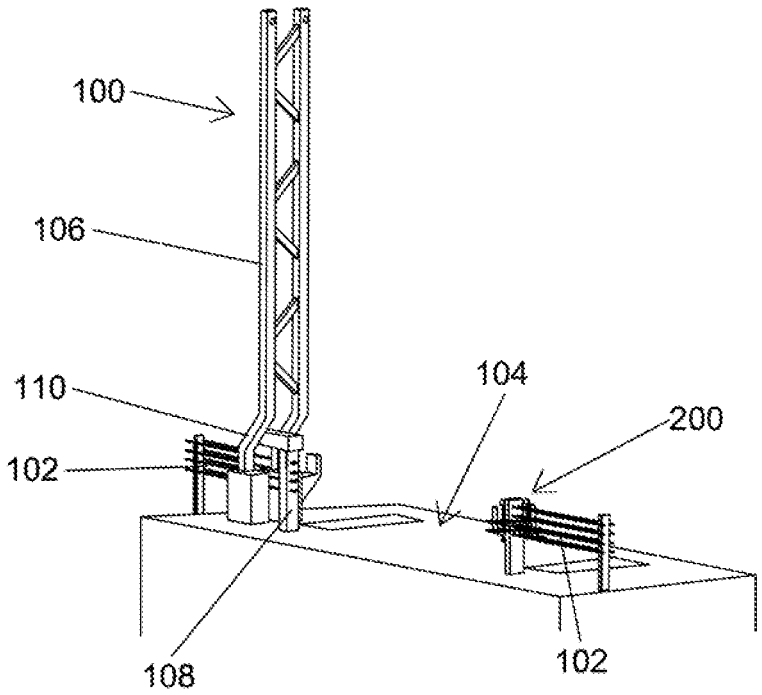

(51) Int. Cl.
*E05C 3/12* (2006.01)
*E05C 5/02* (2006.01)

(52) U.S. Cl.
CPC ..... *E05Y 2900/40* (2013.01); *Y10S 292/29* (2013.01); *Y10T 292/0863* (2015.04)

(58) Field of Classification Search
CPC ..... Y10T 292/0886; Y10T 292/0887; Y10T 292/0892; Y10T 292/314; Y10T 292/323; E01F 13/06; Y10S 292/29; E05C 17/48; E05C 17/50; E05C 5/00; E05C 5/02
See application file for complete search history.

(56) References Cited

U.S. PATENT DOCUMENTS 1,677,960 A * 7/1928 Eskholme ..... E05C 17/50 292/110
1,834,678 A * 12/1931 Bryant ..... E05C 17/48 292/283
1,915,417 A * 6/1933 Harbert ..... B61D 27/0081 292/283
2,358,914 A * 9/1944 Dray ..... E05B 65/0007 292/148
2,631,877 A 3/1953 Ainsworth
3,174,314 A * 3/1965 Johnson ..... E05B 65/0007 70/77
3,675,282 A * 7/1972 Summers ..... A44B 11/25 24/671
3,918,753 A * 11/1975 McCormack ..... E05C 3/24 292/216
4,643,469 A * 2/1987 Johnston ..... E05C 5/00 292/148
6,739,093 B1 * 5/2004 Holbert ..... A01K 1/0017 256/73
8,708,378 B2 * 4/2014 Frazier ..... E05B 63/20 292/137

FOREIGN PATENT DOCUMENTS

FR 2739126 3/1997
GB 129746 A * 7/1919 ..... E05C 17/50
GB 2182712 A * 5/1987 ..... E05B 39/025
GB 2260569 A * 4/1993 ..... E05B 65/102
GB 2300447 A * 11/1996 ..... E05B 13/005
GB 2522238 A * 7/2015 ..... E05B 17/0062
KR 20110006939 A * 1/2011

OTHER PUBLICATIONS

The Patent Office of the Cooperation Council for the Arab States of the Gulf, Search Report for application GC 2019-37934, dated Oct. 4, 2021.
The Patent Office of the Cooperation Council for the Arab States of the Gulf, Search Report for application GC 2019-37934, dated Apr. 15, 2021.

* cited by examiner

LATCH MECHANISM FOR A GATE

FIELD OF INVENTION

The invention relates to a latch mechanism for a gate. In particular embodiments, the latch mechanism includes a rotatable latch for securing a gate in a closed position. The invention is particularly useful for boom gates.

BACKGROUND

Boom gates or boom barriers typically comprise a boom in the form of a pole or bar which is pivoted at one end to allow it to be raised or lowered across a thoroughfare. There are many varieties of boom gates and different options for securing them in the closed position.

The present invention seeks to provide an improved latch mechanism for securing a boom gate in a closed position. However, it should be noted that the invention is not limited to boom gates and may be applied to other variants of gate.

SUMMARY

The present invention provides a latch mechanism according to the appended claims.

Described below is a latch mechanism for a gate, comprising: a main support; a first retention member having a first key aperture and a second retention member having a second key aperture, wherein the first and second apertures are spaced along the main support so as to be separated by a gap. The latch mechanism may further comprise a rotatable latch.

The rotatable latch may comprise: a latch portion; one or more key portions which extend through either or both of the first key aperture and second key aperture; and, an axis of rotation. The rotatable latch may be rotatable about the axis of rotation between a receiving position in which the gate is moveable between an open position and a closed position, or vice versa, and a latched position in which the gate is restrained in the closed position by the latch portion. The one or more key portions may engage with either or both of the first and second retention members when in the latched position to prevent withdrawal of the rotatable latch.

The described latch mechanism may provide a rotatable latch which can be located in a latch mechanism and rotated at will to latch a gate. The combination of features allows an operator to safely and reliably latch the gate with ease. The combination of features also provides a resilient arrangement which can withstand relative high vertical loads which may be experienced during a collision from a large (or small) vehicle. Further, the provision of multiple retention members allows for a staged failure of the latch mechanism.

Either or both of the first and second key apertures may be slots. The first and second key apertures may overlie each other such that there is line of sight through the first and second key apertures along axis of rotation. The first and second key apertures may be the same size.

The first key aperture and the second key aperture may be angularly aligned with each other when viewed along the axis of rotation. Alternatively, the first and second key apertures may be angularly offset from one another when viewed along the axis of rotation.

The latch mechanism may further comprise a neck portion which separates the latch portion and at least one of the one or more key portions. The rotatable latch may be rotatable between the receiving position and latched position whilst the neck portion is in the first key aperture.

The latch mechanism may further comprise a plurality of key portions. Adjacent key portions may be separated by a further neck portion.

At least one of the plurality of key portions may have a first neck portion at a first end and a second neck portion at a second end, wherein the first and second neck portions lie along and define the axis of rotation.

The number of key portions may be the same as the number of key apertures and/or retention members.

The plurality of key portions may be angularly offset by the same amount as the first and second key apertures when viewed along the axis of rotation.

Either or both of the first and second key apertures may include a first slot portion and a second slot portion. The first and second slot portions may be angularly offset.

The rotatable latch may include at least one seat surface which abuts the first or second retention member and limits the travel of the rotatable latch through the first and second key aperture. The travel may be away from the latch portion. The travel may be limited by the seat surface when the rotatable latch is in the receiving position.

The first and second retention members may be flanges. The flanges may be attached to and extend from the main support.

The main support may include a third and fourth retention member on an opposing side of the first and second retention members. The main support may be a post.

The latch portion may include a barrier which passes over a portion of the gate when in the latched position to restrict the movement of the gate relative to the first retention member.

The rotatable latch may comprises a lock portion which engages with a further lock portion external to the rotatable latch. The engagement of the lock portion and further lock portion may prevent rotation of the rotatable latch from the latched position to the receiving position.

The lock portion may comprise a lock aperture. The further lock portion may also prevent the rotation of a further rotational latch.

The key portions may be plates. Either or both of the first and second key apertures may be provided by a v-aperture.

The one or more key portions may comprise a plurality of plate members arranged at an angle to each other.

Also described is a gate system comprising: a boom which is received and restrained by a latch mechanism.

The gate may include two bars. Each bar may be received by a first latch mechanism and a second latch mechanism.

The skilled person will appreciate that except where mutually exclusive, a feature described in relation to any one of the aspects described herein may be applied mutatis mutandis to any other aspect or example. Furthermore except where mutually exclusive any feature described herein may be applied to any aspect and/or combined with any other feature described herein.

BRIEF OVERVIEW OF FIGURES

Figure 2A:
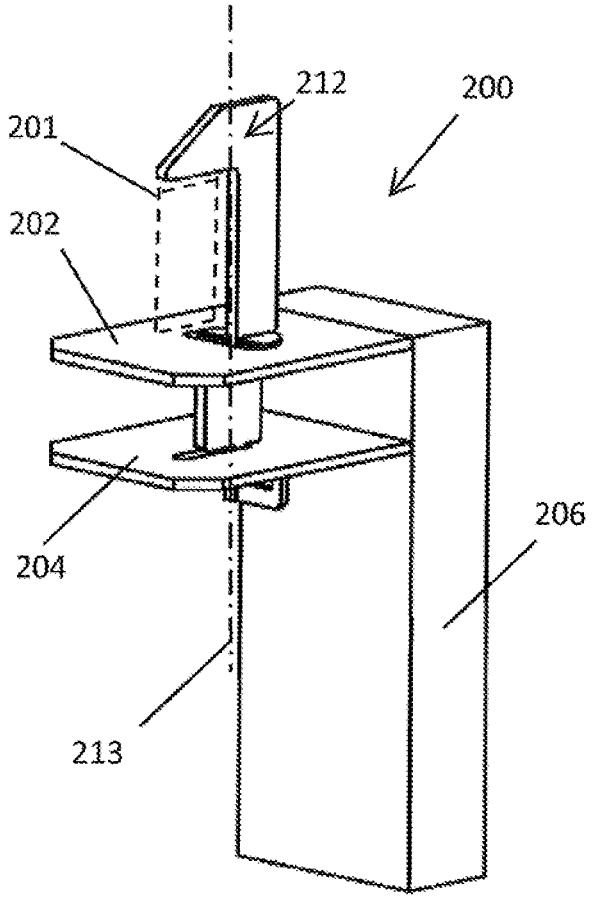
Figure 2B:
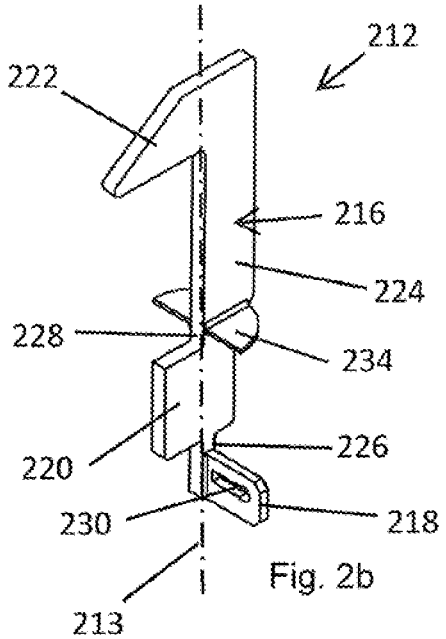

The invention will now be described, by way of example only, with reference to the accompanying drawings, in which:

FIG. 1 shows an overview of a fencing system comprising a boom gate;

FIG. 2*a* shows a perspective view of a latch mechanism;

FIG. 2*b* shows a perspective view of a rotatable latch used in the latch mechanism of FIG. 2*a;*

Figure 2C:
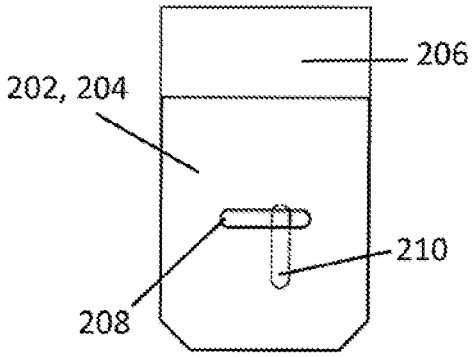

FIG. 2*c* shows a plan view (along the axis of rotation of the rotatable latch) of the retention plates shown in FIG. 2*a;*

FIGS. 3*a* to 3*e* show the installation and operation of the rotatable latch in the latch mechanism of FIG. 2*a*.

Figure 4A:
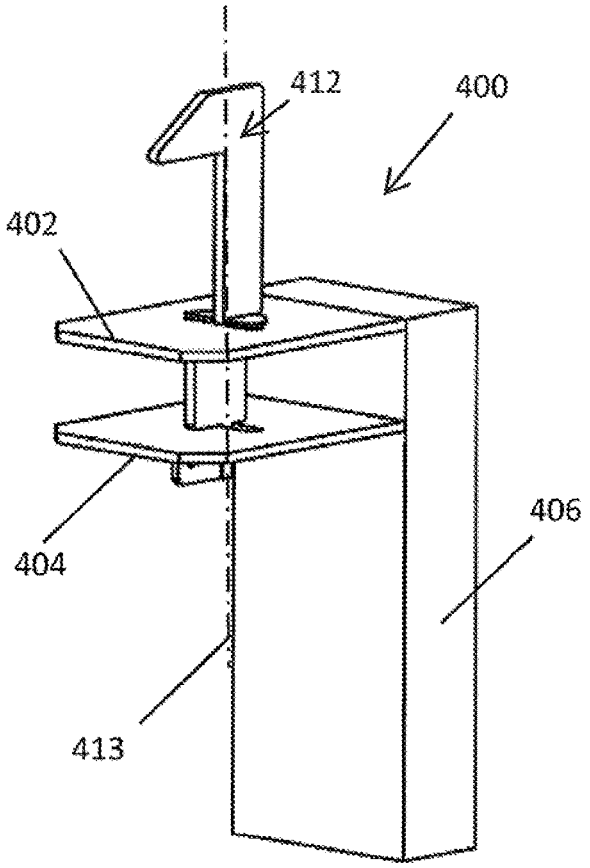
Figure 4B:
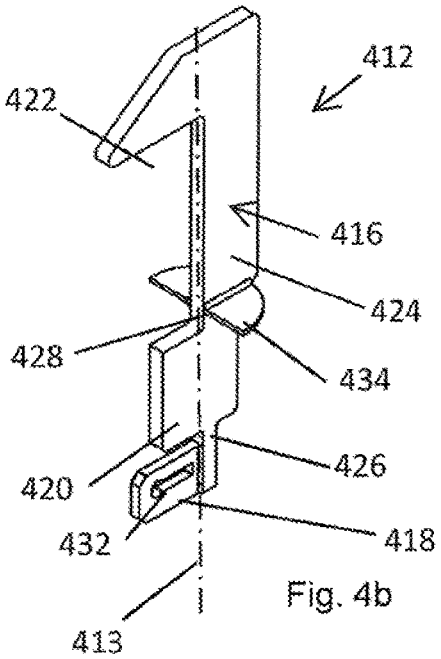

FIG. 4*a* shows a perspective view of a different latch mechanism;

FIG. 4*b* shows a perspective view of a rotatable latch used in the latch mechanism of FIG. 4*a;*

Figure 4C:
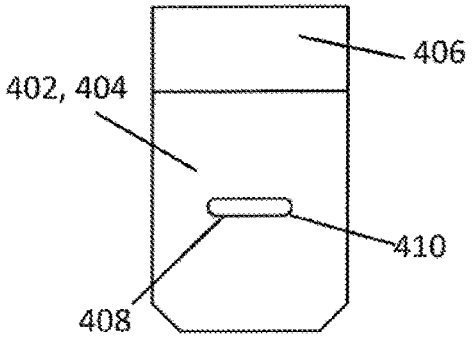

FIG. 4*c* shows a plan view (along the axis of rotation of the rotatable latch) of the retention plates shown in FIG. 4*a;*

FIGS. 5*a* to 5*d* show the installation and operation of the rotatable latch in the latch mechanism of FIG. 4*a*.

Figure 6A:
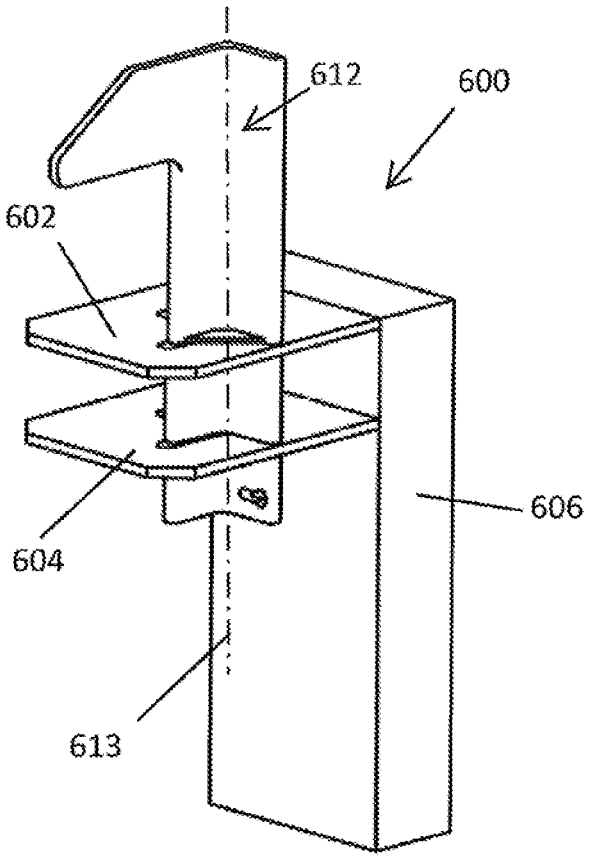
Figure 6B:
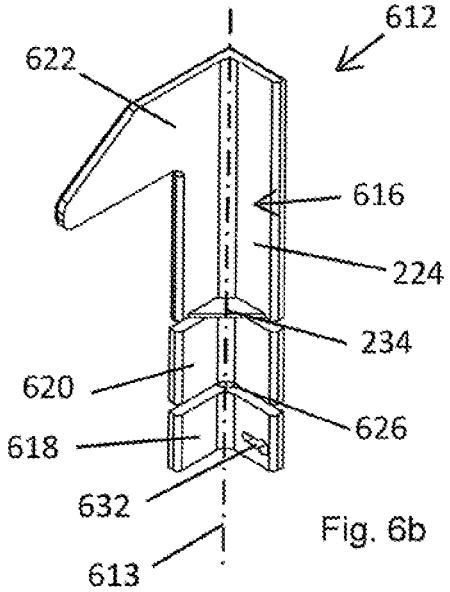

FIG. 6*a* shows a perspective view of a latch mechanism;

FIG. 6*b* shows a perspective view of a rotatable latch used in the latch mechanism of FIG. 6*a;*

Figure 6C:
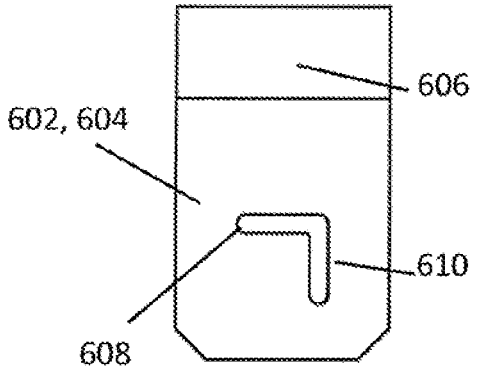

FIG. 6*c* shows a plan view (along the axis of rotation of the rotatable latch) of the retention plates shown in FIG. 6*a;*

Figure 7A:
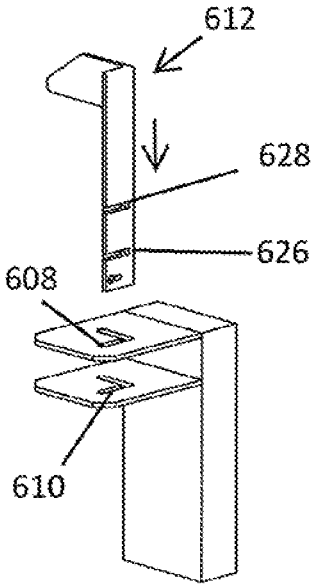
Figure 7B:
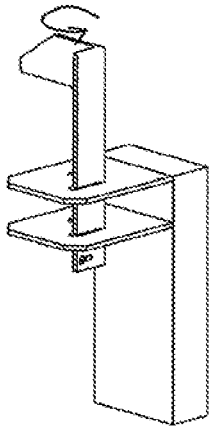
Figure 7C:
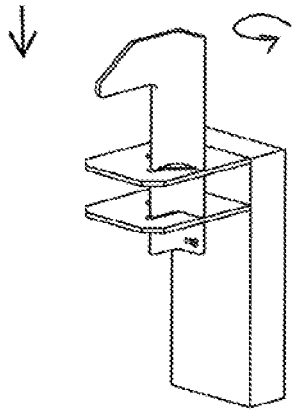

FIGS. 7*a* to 7*c* show the installation and operation of the rotatable latch in the latch mechanism of FIG. 6*a*.

Figure 8:
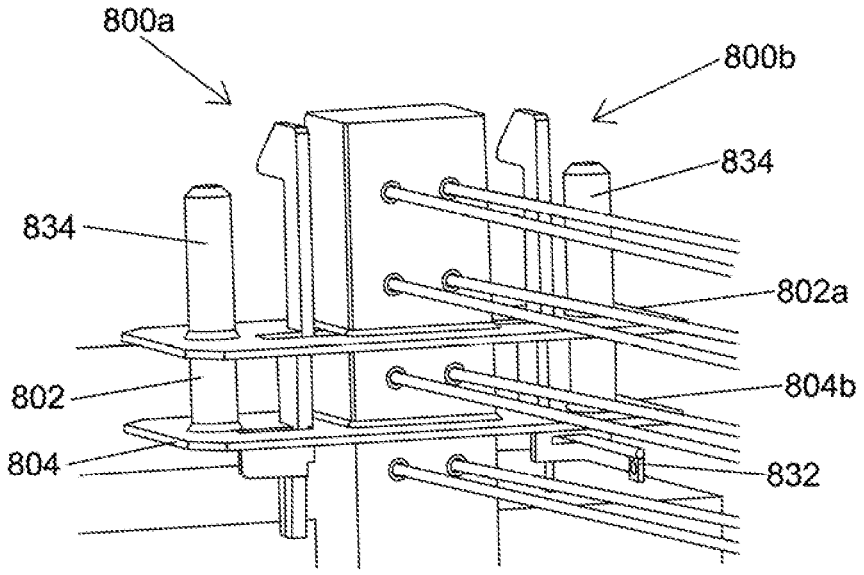

FIG. 8 shows a dual latch mechanism which may be used to restrain the double boom gate of FIG. 1.

DETAILED DESCRIPTION

References to up, down, upper, lower, vertical and horizontal are to be taken to be in relation to the vertical orientation of the axis of rotation of the rotatable latch and main support unless otherwise specified. However, it will be appreciated that the axis of rotation and main support may have alternative orientations in some examples and corresponding positional or geometric references may be appropriate in these instances. References to the axis of rotation may, where appropriate, include where the axis of rotation would be in use or an imaginary axis which is parallel to the axis of rotation.

The latch mechanisms described herein each generally comprise: a main support 206; a first retention member 202 having a first key aperture 208 and a second retention member 204 having a second key aperture 210. The first and second retention members 202, 204 are spaced along the main support 206 so that the first and second key apertures 208, 210 are separated by a gap. The separation will typically be along the axis of rotation.

A rotatable latch 212 employed in the latch mechanisms may comprise: a latch portion 216; one or more key portions 218, 220 which extend through the first key aperture 208 and second key aperture 210; and, an axis of rotation 213. The rotatable latch 212 may be rotatable between a receiving position in which the gate is moveable between an open position and a closed position, or vice versa, and a latched position in which the gate is restrained in the closed position by the latch portion 216. The one or more key portions 218, 220 may engage with either or both of the first and second retention member 204 when in the latched position to prevent withdrawal of the rotatable latch 212 and movement of the gate to the open position.

FIG. 1*a* shows a gate 100 for which the latch mechanism may be used. The gate is located at a break in a line of fencing 102 and allows control over the thoroughfare 104 which extends through the line of fencing 102.

The gate 100 includes a boom 106 which is rotatably mounted to a support structure in the form of a post 108, by a hinge 110. The hinge 110 provides a horizontal pivot allowing the boom 106 to move from an upright, open position, to a horizontal, closed position (not shown). Thus, the gate 100 is actuated in a vertical plane.

When in the closed position, a portion of the boom 106 towards or at the free end lies on a portion of the latch mechanism 200 such that it can be restrained by the latch mechanism 200. The latch mechanism 200 restrains the boom 106 to prevent significant upwards movement of the boom 106. The capture may be a direct engagement with the boom 106, but more typically, will provide a stop to limit the amount of movement that the boom can undergo.

In the example shown, the gate 100 is used as part of an antivehicle system suitable for inhibiting the progress of large vehicles. As such, the gate boom 106 comprises a pair of parallel members joined together by a plurality of diagonal reinforcing braces, similar to a warren girder, and is counterweighted on the opposing side of the hinge to allow the boom to be more readily manoeuvred. As such, the gate system and latch mechanism 200 is intended to handle significant lateral and vertical forces which may be experienced from an impacting vehicle.

It will be appreciated that the other configurations of gate may benefit from the invention. For example, the gate may have a single boom or may be vertically hinged so as to swing in a horizontal (or some other) direction/plane, rather than vertical, as shown.

To aid the resilience of the gate system, the example shown in FIG. 1 includes two latch mechanisms, as shown in FIG. 8. The two latch mechanisms are located on either side of a main support post and provide a vertical restraint to each of the boom members individually. Again, it will be appreciated that having two latch mechanisms is not essential and a single latch may suffice for the gate shown in FIG. 1 or other gates.

FIG. 2*a* shows a latch mechanism 200 in a closed configuration. FIG. 2*b* shows the rotatable latch 212 of FIG. 2*a*, and FIG. 2*c* shows a plan view of the retention members 202, 204 (which overlie each other) and main support of FIG. 2*a*. The latch mechanism 200 includes a first retention member 202 and a second retention member 204, both of which are attached to a main support 206. The main support 206 is in the form of a post, but it will be appreciated that the main support 206 may take the form of a wall, column, or other static structure which provides a suitable support for the latch mechanism 200 and a gate. It will also be appreciated that the main support 206 may be provided by multiple parts, which are not directly joined but which are substantially static in relation to one another.

The first 202 and second 204 retention members may be in the form of plates/flanges which are affixed to and cantilever from the main support 206. The method of fixing may be any suitable known in the art, such as welding or bolted. In other examples, the retention members 202, 204 may be provided by opposing upper and lower walls of box section, by a bridge which extends between two or more main supports, or by any extension, box, column, arm, member, flange, protrusion, loop, band, or other feature, which can provide the key apertures 208, 210, required to engage with the key portions 218, 220 of the rotatable latch 212. FIG. 8 includes an example in which a pair of latch mechanisms are positioned on opposing sides of a main support with the opposing retention members being provided by a common plate through which the support post passes.

The first 202 and second 204 retention members are distributed along the main support post so as to provide an upper member and a lower member, with the two members being separated by a gap. It will be appreciated that there may be two or more retention members and these may be distributed along the main support. An advantage of providing multiple retention members is that it allows for more contact points between the rotatable latch and main support.

Providing two or more retention plates allows for a staged breakdown of the locking mechanism.

At least one of the retention members 202, 204 may provide a surface against which the gate can rest. At least one of the retention members 202, 204 may provide a surface on which the rotatable latch 212 can rest and be rotated. The first retention member 202 may be taken to be the uppermost member, as shown in the figures, and provide both of these functions.

The first 202 and/or second 204 retention members may provide a load bearing surfaces against which the rotatable latch 212 can react to limit the movement of the gate when held in the latched position. The engagement between the first 202 and second 204 retention members and rotatable latch 212 is described further below. Providing two retention members with load bearing surfaces provides an increased restraint with which to withstand vertical loads on the gate.

The retention members 202, 204 can be have a plate-like construction with a length corresponding to the extent of the structure away from the main support, a width corresponding to the extent of the member across the main support, and a thickness provided by the depth of the member in relation to the rotational axis. The upper and lower surfaces of each retention member may provide the gate support surface and load bearing surfaces respectfully.

The proportions of the retention members 202, 204 may be any desired but will typically provide the restraint necessary for a particular size or rating of gate. The width of the member may be less than, equal to or greater than the width of the main support 206. The length of the member may be influenced by the size of the gate and dimensions of the rotatable latch 212.

The first 202 and second 204 retention members may be plates positioned parallel to each other and in a horizontal orientation, as shown. As such, the first 202 and second 204 retention members may be considered to have at least one surface orthogonally arranged in relation to the main support. The surface may be the upper surface or lower surface of the retention member 202, 204. It will be noted that each of the retention members 202, 204 may have tapered or rounded corners to remove any hazardous corners or sharp features. The retention members may be sized to be substantially the same.

Each of the first 202 and second 204 retention members include a key aperture 208, 210. Thus, there is a first key aperture 208 in the first retention member 202, and a second key aperture 210 in the second retention member 204.

A purpose of the key apertures 208, 210 may be to provide a hole through which one or more key portions of the rotatable latch 212 can pass, when in a first orientation, but which restrict the withdrawal of the key portion when the rotational latch 212 is in a second orientation.

The key apertures 208, 210 may have a width and a length in the plane which is normal to the axis of rotation 213, which, in the case of FIG. 2*a*, is in the plane of the respective retention member 202, 204. The length of the aperture may be greater than the width such that the first and second key apertures are elongate. The key apertures may be oval or rectangular, straight, curved or angled so as to have multiple straight or curved sections set at an angle to each other. Thus, the key aperture may be 0, V, M, S, T, W, X, Y or Z shaped, for example.

In one example, the key apertures 208, 210 may be provided by longitudinal slots (e.g. slits) having a longitudinal axis extending in the normal plane. Such a slot can accept a correspondingly shaped key portion in a first angular orientation which is aligned with the elongate slot, but be prevented from being withdrawn when rotated out of alignment.

In some examples, the key apertures 208, 210 may include more complex or irregular shapes and have meandering or curved portions. The key apertures 208, 210 may have one or more notches or other features which provide the apertures with an orientation specific gateway through which one or more of the key portions can pass.

As can be seen from FIG. 2*c*, the first key aperture 208 and second key aperture 210 may be aligned in the vertical direction such that there is line of sight through the first and second key apertures 208, 210 when viewed along the rotational axis 213 of the rotatable latch 212. The area of overlap between the first key aperture 208 and second key aperture 210 may be full or partial. The partial overlap may be due to a linear offset or an angular offset with respect to the rotational axis 213. In FIG. 2*c*, the first 208 and second 210 apertures are perpendicular to each other thereby providing only a small overlap which is sufficient to rotatably receive the rotating parts of the rotatable latch.

The rotatable latch 212 may comprise a latch portion 216. The latch portion 216 may comprise a latch 222 (a barrier) which can be rotated into place to limit the movement of the gate once the gate is in the closed position. The latch 222 may reside above the first retention member 202 and be separated therefrom by a gap which is sufficient to receive a corresponding portion of the gate. The latch may be attached by a latch arm 224 which connects the latch 222 to the remainder of the rotatable latch 212 parts. The latch may be any suitable member such as a bar, arm, member or other overhanging, cantilevered, protuberant feature which obstructs the upward motion of the gate when latched. The latch may be arranged at right angles to the axis of rotation 213 or may include an inclined surface or one or more protuberant features to help entrain the gate during a vertical movement of the latter.

As can be seen in the example of FIG. 2*b*, the latch 222 and latch arm 224 may be provided in the form of a hook or inverted L shape. The latch 222 and latch arm 224 may be formed as a unitary structure. The latch 222 and latch arm 224 may be formed from a plate of metal with both the latch and latch arm lying in a common plane. One or more of the key portions may lie in a common plane with either or both of the latch arm 224 or latch 222.

The rotatable latch 212 may be rotatable at least between a receiving position in which the gate is moveable between an open position and a closed position, and a latched position in which the gate is restrained in the closed position by the latch portion 216. In FIG. 2*a*, the rotatable latch 212 is shown in the latched position in which the latch portion 216 is perpendicular to the main support, or more particularly, at least parallel so as to not enter the plane of travel of the gate. The receiving position may be provided by the latch portion 216 being parallel to the main support 206 or at least partly in the plane of travel for the gate and/or above a portion of the gate so as to be arranged to limit the movement of the gate.

The rotatable latch 212 may further comprise a key. The key may be configured to extend through the key apertures 208, 210 to prevent withdrawal of the rotatable latch 212 when in specific rotational orientations. The key may include a plurality of key portions 218, 220. The plurality of key portions 218, 220 may be separated by one or more neck portion 226, 228. The rotatable latch may include one or more mechanical fuses. The mechanical fuses may be arranged to provide a controlled or staged failure of the lock.

The mechanical fuses may be provided by the neck portions 226, 228. The neck portions 226, 228 may provide frangible sections of the rotatable latch which fail simultaneously or in a predetermined sequence when sufficiently loaded. Thus, the rotatable latch may be configured to have a multiple stage failure under loading. In one example, the failure of the first neck portion 226 may occur before the second neck portion 228. The sequence of failure may be determined by the relative dimensions of the neck portions 226 and 228, and/or by the spacing of the upper surface of each associated key portion 218, 220 and the underside of the respective retention plate 202, 204. For example, the spacing between the upper edge of the first key portion 218 and the underside of the second retention plate 204 may be less than the separation of the second key portion 220 and the first retention plate 202. Hence, when being urged upwards in the event of a collision (or otherwise), the first key portion 218 contacts the underside of the second retention plate 204 prior to the contact between the first retention plate 202 and second key portion 220. Hence, the first neck portion 226 will be the first to be loaded and fail. It will be appreciated that providing multiple retention plates allows for multiple failure points, with each retention plate providing a stage of a staged failure.

Each of the plurality of key portions 216, 218 may have a length, width and thickness. In the example shown, the key portions are members having a thickness that corresponds to the width of the key apertures, a length which relates to an axial length in relation to the axis of rotation 213, and a width which corresponds to the radial direction of the rotational axis 213 and length of the longitudinal key apertures 208, 210.

The neck portions 226, 228 may have smaller dimensions than the adjacent key portions. Thus, the neck portions 226, 228 may be shorter in length and/or width than the adjacent key portions. The neck portions 226, 228 may have the same thickness as the key portions.

A key aperture 208 may have one or more common dimensions with another key aperture 210. A key portion 218 may have one or more common dimensions with another key portion 220. Hence, the width of the key apertures 208, 210 may be the same, as may the length. Similarly, the key portions 218, 220 may have the same width, length or thickness. The key apertures 208 and 210 may be sized and shaped to closely correspond to the key portions 218, 220. As can be seen in FIG. 2*b*, the thickness of the key portions 218, 220 are the same as each other but less than the width of the key apertures 208, 210 such that they can pass therethrough when suitably aligned. The length of the first key portion 218 may be less than the length of the second key portion 220. The key portions 216, 218 may also be angularly offset relative to each other when viewed along the rotational axis 213. The angular offset may be the same as the angular offset of the key apertures. The angular offset may be 90 degrees relative to an adjacent key portion.

The first key aperture 208 may be sized to receive the first and second key portion 220. The second key aperture, which corresponds to the lower retention member in the example of FIG. 2*a*, may be sized to only receive the first key portion 218.

The rotatable latch 212 may include one or more seat surfaces 234 on which the rotatable latch 212 can be seated on one of the retention members 202, 204. The seat surfaces 234 may be provided by one or more flanges 228 or an edge of one of the key portions 218, 220. The one or more seat surfaces 234 may provide a surface which abuts the first retention member 202 when the rotatable latch 212 is inserted into the first 208 and second 210 key apertures.

The seat surface 234 may provide a stop to limit the axial insertion of the rotatable latch 212. The seat surface 234 may further provide a stable surface on which the rotatable latch 212 can rest whilst it is rotated.

The seat surface 234 may take any suitable shape and may be placed in any suitable location. As shown in FIG. 2*b*, the seat surface 234 may be provided by one or more flanges which extend from the rotatable latch 212 on the proximal end of the latch arm 224 but such flanges or seat surfaces 234 could be provided elsewhere and may abut surfaces other than one of the retention members. For example, the seat surface 234 may engage with another surface provided above, below, or in between the retention members.

The rotatable latch 212 may additionally include a lock portion 230. The lock portion 230 may be configured to engage with a further lock portion 232 which is separate to the rotatable latch 212. The lock portion 230 may be provided by one or more features which can engage with or couple to the further lock portion 232. For example, the lock portion 230 may include a lock aperture which can receive a corresponding part of the further lock portion 232. Alternatively, the lock portion 230 may include a latch, band, pin, hasp or other suitable formation or feature. The engagement of the lock portion 230 and further lock portion 232 may prevent the rotatable latch 212 from being accidentally or purposely rotated when in the latched position and locked.

In the example of FIG. 2*a*, the lock portion 230 is provided by an aperture in the proximal terminal end of the rotatable latch 212. The lock portion 230 may be provided as part of a key portion 218, 220, or part thereof. For example, the lock portion 230 may be provided by an aperture in a key portion 218 as shown in FIG. 2*a*. Providing an aperture in the key portion 218 is advantageous as it can be incorporated into rotatable latch 212 and pass through a key aperture 208, 210 with no other specific modification, which may be required if the lock portion 230 included a protuberant feature.

Each key portion 218, 220 may comprise a body having a length and width. The length may be provided by the extent of the key portion 218, 220 along the rotational axis 213 and may be defined by an upper edge and lower edge of the body. The upper edge may comprise a restraining surface which abuts the underside of one of the first or second restriction members 202, 204 and prevents the axial withdrawal through the key aperture 208, 210 when the respective key portion 218, 220 has been rotated out of alignment with the key aperture 208, 210. Each key portion 218, 220 may include an upper edge restraining surface such that any axial withdrawal force on the rotatable latch 212 is distributed across multiple retention members.

The lower edge of any or all of the key portion bodies may include a lower bearing edge surface. The lower bearing edge surface may sit on the upper surface of a respective retention member and prevent the axial withdrawal through the aperture in a downwards direction under the weight of the rotatable latch 212 when in situ and rotated away from the aperture. This function may be shared with the aforementioned seat surface 234.

The length of a central key portion 220 may be approximately equal to the separation of the first and second retention members 202, 204 so as to be received therebetween with a clearance suitable for rotation and any in-service movement. The length of the lower, first key portion 218 may be less than the second key portion 220. The length of the first key portion 218 may be determined by the dimensions of the lock portion 230.

The widths of the key portions are defined by outer lateral edges which extend between the upper and lower edges. The key portion may be any suitable shape, including rectangular, as shown in FIG. 2.

The angular offset between the first key portion 218 and the second key portion 220 may be the same as the angular offset between the first key aperture 208 and second key aperture 210. Providing the same offset means that the first and second key portions 218, 220 can pass through the respective apertures at the same time with axial displacement of the rotatable latch 212.

The neck portions 226, 228 represent a narrowing of the rotatable latch 212 between parts. The thickness and width of the neck portions 226, 228 may be similar to one another and may correspond to the thickness of one or more of the key aperture widths such that the rotatable latch 212 can rotate when the neck portions 226, 228 are located in the key apertures. The first and second neck portions 226, 228 may be axially aligned define the axis of rotation 213 for the rotatable latch 212.

Looking at FIG. 2*a* in more detail, there is shown two retention plates 202, 204 which are cantilevered off the main support post. The main support post has a rectangular transverse section which is fixed into the ground (or some other suitable base) to provide a rigid and robust support for the latch mechanism 200. The first retention member 202 is located at the terminal end of the post but may be located a distance from the absolute end to provide an upright extending beyond the latch mechanism 200. Such an upright could be used to help retain the barrier in conjunction with the rotatable latch 212.

The first and second retention members 202, 204 include respective first and second key apertures 208, 210 which receive the rotatable latch 212 in use. The first and second key apertures 208, 210 are elongate slots having a major axis and minor axis in the plane of the member. The size and shape of the first and second key apertures 208, 210 are the same. However, the major axes of the first and second key apertures 208, 210 are orthogonally arranged relative to each other but partially overlap when viewed from above to provide a direct line of sight through the retention members along the rotational axis 213. The first key aperture 208 lies parallel to the inner surface of the post, the second lies at right angles to the post, but this is not essential. The point of overlap between the first and second key apertures 208, 210 is provided at the terminal end of one of the apertures and part way along the length of other aperture. Thus, when viewed from above, the overlapping apertures form a notional T-shape.

The rotatable latch 212 comprises: a first key portion 218; a first neck portion 226; a second key portion 220; a second neck portion 228; a seat surface 234 flange; and a latch portion 216 in axial series. A lock portion 230 is incorporated into the first key portion 218. Thus, the proximal terminal end of the rotatable latch 212 is provided by a first key portion 218 which comprises a rectangular body that includes a lock portion 230 aperture for receiving a corresponding further lock portion 230. The width of the first key portion 218 is less than the first and second key apertures 208, 210 so that it can pass freely through the respective apertures when properly aligned thereto.

The first key portion 218 terminates in a neck portion 226 which is located at a lateral edge of the key portion 218 and has a thickness and width slightly less than the width of the first and second key apertures 208, 210 so that the rotatable latch 212 is rotatable about the neck portion 226. The length of the neck portion 226 is greater than the thickness of the retention members 202, 204 to provide sufficient clearance for the key portions above and below the retention member 202, 204.

The opposing end of the neck portion 226 terminates the second key portion 220 which is provided by a relatively thin rectangular body. The length of the second key portion 220 is similar to the separation of the first and second retention members 202, 204 but reduced to allow a rotating clearance. The width of the second key portion 220 is similar to the first key portion 218 and less than the length of the key aperture to allow the key portion to pass therethrough. The second key portion 220 is aligned with the latch portion 216 so as to be in the same plane.

The second key portion 220 terminates in second neck portion 228 which is similarly dimensioned to the first neck portion 226 and allows rotation in the apertures.

The second neck portion 228 terminates in the latch portion 216 and seat surface 234. The seat surface 234 is provided by two cantilevered wings which extend laterally from the latch portion 216. The wings are symmetrically arranged and take the form of quarter circle members although it could be provided by a full circle or other shape. The underside of the seat surface 234 resides on the upper side of the first retention member 202 when the rotatable latch 212 is fully inserted into to the first and second members.

The latch portion 216 includes a latch arm 224 and a latch 222 which provides the barrier to restrict the gate movement. The length of the latch arm 224 is at least the height of corresponding portion of the gate over which it resides when in the latched position. When the gate is closed and resting on the retention member 204 upper surface, the latch portion extends around the outside of the gate. However, there could be examples, where the latch portion extends through a gate boom in an appropriate aperture.

The key portion 220, latch portion 216 and neck portions 226, 228 may be made from a unitary part. The unitary part may be made from a single sheet of metal which has been cut or punched to a suitable template. Alternatively, one or more of the parts may be joined on to the rotatable latch 212, such as the first key portion 218, by a suitable method such as welding. The gate is not shown for clarity, but the position the boom would occupy is shown in section by the dashed rectangle 201.

Figures 3A, 3B, 3C, 3D, 3E:
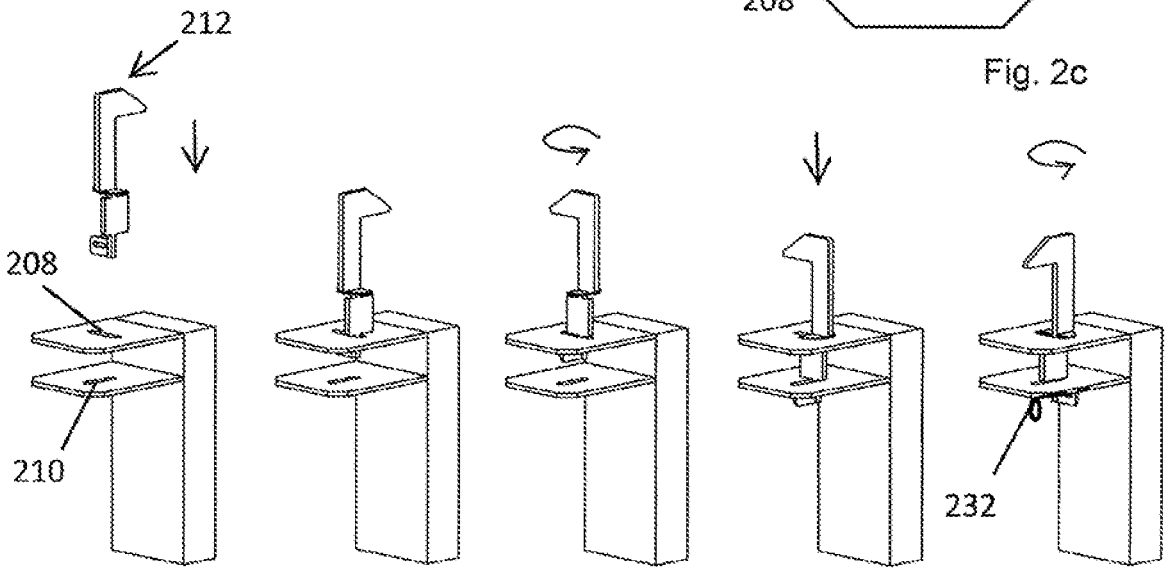

FIGS. 3*a* to 3*e* show the installation process for the latch mechanism 300 shown in FIG. 2. FIG. 3*a* shows the rotatable latch 212 being lowered axially towards the first retention member 202 with the first key portion 218 aligned with the first key aperture 208. The first key portion 218 is inserted through the first key aperture 208 until the first neck portion 226 is received within the first key aperture 208 such that the rotatable latch 212 can be rotated through 90 degrees, as shown in FIG. 3*b*.

FIG. 3*c* shows the rotatable latch 212 turned through 90 degrees so that the first key portion 218 is aligned with the second key aperture 210 in the second retention member 204 and the second key portion 220 is aligned with the first key aperture 208 in the first retention member 202. To provide lateral alignment of the first key portion 218 with the second key aperture 210, it is necessary to move (slide) the rotatable latch along the first key aperture 208.

FIG. 3*d* shows the rotatable latch 212 inserted fully into the key apertures such that the seat surface 234 rests on the upper surface of the first retention member 202 and the first and second neck portions 226 and 228 are located in the first and second key apertures 208, 210 respectively. In this position, the rotatable latch 212 may be rotated fully in 360 degrees.

At this point the rotatable latch 212 is in the receiving position such that the gate can be lowered in to a closed position. In this example, the latch arm 224 is provided between the gate boom and the main support, however, there may be examples in which the boom is located between the latch arm 224 and main support 206. When the gate is lowered, a portion rests on the upper surface of the retention member 202.

Whilst in the shown receiving position, the key portions are still aligned with the key apertures, however, the receiving position will typically include a range of angles in which a space is provide for the gate to move into the fully closed position. Hence, the receiving position may include positions in which the rotatable latch 212 may or may not be withdrawn from the retention plates.

From the receiving position, the latch may be rotated about the axis of rotation so as to reside above the boom (FIG. 3*e*). In doing so, the key portions 218, 220 are rotated and moved out of alignment from the key apertures 208, 210, thus preventing withdrawal of the rotatable latch 212 in an axial direction. As with the receiving position, the latched position will typically represent a range of angles.

Once in the desired latched position, a further lock portion in the form of a pin 232 is inserted into the lock portion 230 aperture to prevent rotation of the rotatable latch 212. The pin 232 may be inserted into a hole in the main support or otherwise held to prevent rotational movement. The pin 232 may be additionally locked off with a padlock or the like.

It will be noted that when in the latched position, the key portion 220 which is located between the retention members includes an upper surface which engages with the underside of the retention member 202 on either lateral side of the neck portion and key aperture. Similarly, the key portion which resides below the lower retention member 204 includes an upper surface which engages (or is engagable) with the underside of the retention member to the side of the neck portion and key aperture. The lower edge of the key aperture may or may not contact the upper surface of the lower retention member to supplement or provide a seat surface 234 on which the latch 222 can be rotated.

FIGS. 4*a*, 4*b* and 4*c* show alternative retention member key apertures 408, 410 and a corresponding alternative rotatable latch 412. Here, the first and second key apertures 408, 410 are in-line with each other and have corresponding size and shape. Thus, as shown in the plan view of FIG. 4*a*, only one slot can be seen from above.

The rotatable latch 412 is similar to that shown in FIG. 2 with similar features which will not be unnecessarily described again but which are represented by similar reference numerals incremented by 200. A difference between the rotatable latch 212 of FIG. 2, and that of FIG. 4*b*, is the first and second key portions 418, 420 are in the same plane so as to be in-line and not angularly offset. The first neck portion 426 which resides between the first and second key portion 420 is placed at a lateral edge of the first key portion 418 and joins the second key portion 420 at a mid-region of the lower edge thereof. The second neck portion 428 which partitions the second key portion 420 and latch portion/seat surface 434 is in line with first neck portion 426 to provide the axis of rotation 413.

The overall combined width of the first and second key portions 418, 420 may be the same as the length of the first and second key apertures 408, 410 such that the first and second key portions 418, 420 can pass through their respective apertures whilst the rotatable latch 412 is inserted directly along the axis of rotation 413.

An advantage the arrangement of FIGS. 4*a* and 4*b* is that the rotatable latch 212 can be loaded into the retention members without being rotated. A disadvantage is that the rotatable latch 412 can traverse the key apertures such that it can move laterally with respect to the gate boom when in the receiving and latch positions. This is in contrast to examples where an angle between the key apertures prevents any lateral movement, such as that shown in FIG. 2*c*. In that example, lateral movement along the second key aperture 210 is prevented by the neck portion being restricted in the first key aperture 208 meaning that the rotatable latch 212 can only rotate.

FIGS. 5*a* to 5*d* show the installation of the rotatable latch 412 of FIGS. 4*a-c*.

Figures 5A, 5B, 5C, 5D:
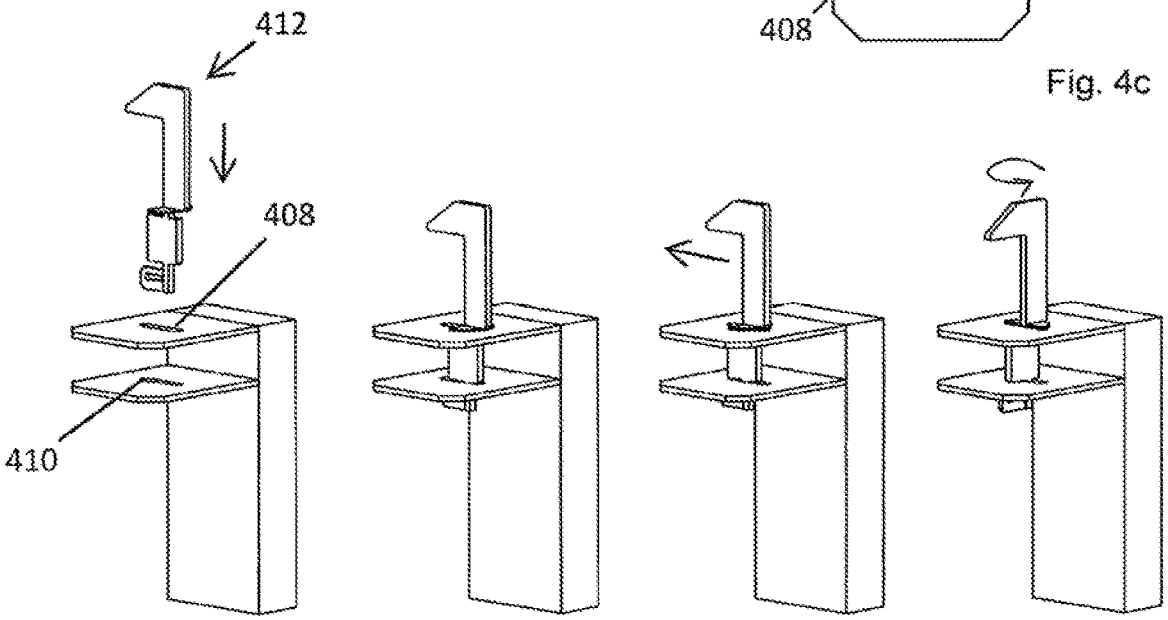

The rotatable latch 412 is presented above the first key aperture 408 such that the first key aperture 408 and first key portion 418 are aligned with one another, as shown in FIG. 5*a*. FIG. 5*b* shows the rotatable latch 412 residing on the first retention member 402, resting on the underside of the seat surface 434. This state was achieved by inserting the first and second key portions 418, 420 through the first and second key apertures 408, 410 in a single movement without rotation.

Once inserted, the rotatable latch 412 can be rotated from the receiving position to the latched position (FIG. 5*d*). Alternatively or additionally, the rotatable latch 412 can be moved along the key apertures such that the upper edges of the first and second key portions 418, 420 overrun the terminal end of the key apertures 418, 420 and rest in opposition to the underside of the respective retention members to prevent withdrawal of the rotatable latch 412 in the upwards direction (FIG. 5*c*). The lateral movement and overlap of the key portions 418, 420 and key apertures 408, 410 helps prevent the rotatable latch being axially withdrawn whilst in the receiving portion.

FIGS. 6*a* and 6*b* show yet a further example of latch mechanism 600 which is similar to that shown in FIG. 2 with similar features which will not be described again but which are represented by similar reference numerals incremented by 400.

In FIGS. 6*a* and 6*b*, the key apertures 608, 610 are provided by an angled aperture comprising a plurality of discrete sections. The discrete sections are provided at an angle to one another. In the example shown, the key apertures 608 and 610 include a first section and a second section connected end to end and angularly offset from one another to provide a V-shaped aperture when viewed from above. The angle between the first and second sections is approximately 90 degrees but this is not a limitation and the angle may be any suitable angle desired. The angle may be any between 45 degrees and 135 degrees, for example. The sections of the key apertures 608 610 may be straight or curved and there can be any number of sections in a linear series.

The rotatable latch 612 may include corresponding key portions 618, 620 which comprise plates set at an angle to each. The join between the plates is provided along the rotational axis, and the angle between the plates matches that the angle between the sections of the aperture. The angle may be any between 45 degrees and 135 degrees for example. Thus, the key portions have comprises a first plate and a second plate which meet at a corner region. The key portions are separated by neck portions, as per the other embodiments, with the neck portion being provided at the corner region and defining the axis of rotation.

The seat portion 634 is provided by a web which extends across the internal angle between the first and second plates of the adjacent the first neck portion such that it can rest on the upper surface of the first retention plate.

The latch portion may include a similar angled construction. Thus, the arm portion and/or the latch 622 may include a pair of plates which extend from a corner region which is coaxial with the rotational axis.

An advantage of the example of FIGS. 6*a* and 6*b* is that the rotatable latch can be provided by a section of so-called angle iron which has a plurality of slots in the leaves/plates to provide the narrowed neck portions and define the key portions and latch arm. The latch 622 can be provided in one of the leaves by removing a suitable section.

FIG. 8 shows a pair of latch mechanisms 800*a*, 800*b* arranged either side of a main support in the form of a post. Each of the latch mechanisms 800*a*, 800*b* may be provided by any of the examples described herein, however, the ones shown are similar to those described in connection with FIG. 2*a*. The lock 230 which prevents the rotation of the rotatable latches is provided by a pin 832 which extends through the lock portion in both the first 800*a* and second 800*b* rotatable latches. Thus, the pin is held in a secure enough location to prevent rotation. The pin 832 also includes a lug on an end thereof which can be aligned with the elongate lock aperture of the key portion prior to it being rotated to prevent withdrawal from the lock portion. The lug includes a further aperture for receiving a pad lock or similar.

Thus, in FIG. 8 there is shown first 802, second 804, third 802*a* and fourth 804*a* retention members, in which the third and fourth retention members are located on the opposite side of the support post to the first and second retention members.

Thus, there may be a latch mechanism in which a pin passes through the rotational latch lock portion 230 and a second lock portion 230 provided by a second rotational latch which is held by the third and fourth retention members.

Each of the latch mechanisms in the example of FIG. 8 or elsewhere may include a location post 834 which mates with a corresponding orifice in the gate boom. The location post may be used to aid location, or strengthen the location of the boom relative to the latch portion, thereby make the arrangement more resilient to a vehicle impact.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A latch mechanism for a gate, comprising:

a main support;

a first retention member having a first key aperture and a second retention member having a second key aperture, wherein the first and second members are spaced along a vertical direction on the main support so as to be separated by a vertical gap;

a rotatable latch comprising:

a latch portion;

a seat;

a first key portion extending in a first direction;

a neck portion; and a second key portion extending in a second direction;

the first and second key portions configured to extend through the first key aperture and second key aperture respectively;

an axis of rotation extending vertically along the main support, wherein, when the rotatable latch is mounted on the first and second retention members, the seat is configured to rest against the first retention member restricting movement of the latch portion along the axis of rotation towards the first retention member, the first key portion is configured to be positioned between the first and second retention members, and the second key portion is configured to be positioned below the second retention member;

wherein when the rotatable latch is mounted on the main support, the rotatable latch is rotatable about the axis of rotation between a receiving position in which the rotatable latch is disengaged from the gate and the gate is moveable between an open position and a closed position, or vice versa, and a latched position in which the rotatable latch is movable about the axis of rotation to receive a portion of the gate between the latch portion and the first retention member such that the latch portion restrains the gate in the closed position, wherein in the latched position the first and second key portions engage with the first and second retention members to prevent withdrawal of the rotatable latch;

wherein in the area of the neck portion and the seat, the rotatable latch is configured to interact with the first retention member and the second retention member to provide a staged failure of the rotatable latch when the rotatable latch is in the latched position and under load against the gate.

2. A latch mechanism as claimed in claim 1, wherein either or both of the first and second key apertures are slots.

3. A latch mechanism as claimed in claim 1, wherein the first and second key apertures overlie each other such that there is line of sight through the first and second key apertures along axis of rotation.

4. A latch mechanism as claimed in claim 1, wherein the first and second key apertures are the same size.

5. A latch mechanism as claimed in claim 1, wherein the first key aperture and the second key aperture are angularly aligned with each other when viewed along the axis of rotation.

6. A latch mechanism as claimed in claim 1, wherein the first and second key apertures are angularly offset from one another when viewed along the axis of rotation.

7. A latch mechanism as claimed in claim 1, wherein the rotatable latch is rotatable between the receiving position and latched position whilst the neck portion is in the first key aperture.

8. A latch mechanism as claimed in claim 1, wherein the neck portion comprises a first neck portion at a first end of the first key portion and a second neck portion at a second end of the first key portion, wherein the first and second neck portions lie along and define the axis of rotation.

9. A latch mechanism as claimed in claim 6, wherein the first and second key portions are angularly offset by the same amount as the first and second key apertures when viewed along the axis of rotation.

10. A latch mechanism as claimed in claim 1, wherein the first and second key apertures include a first slot portion and a second slot portion, wherein the first and second slot portions are angularly offset.

11. A latch mechanism as claimed in claim 1, wherein the first and second retention members are flanges attached to and extending from the main support.

12. A latch mechanism as claimed in claim 1, wherein the main support is a post.

13. A latch mechanism as claimed in claim 12, wherein the post includes a third and fourth retention member on an opposing side of the post to the first and second retention members.

14. A latch mechanism as claimed in claim 1, wherein the latch portion includes a barrier which passes over a portion of the gate when in the latched position to restrict the movement of the gate relative to the first retention member.

15. A latch mechanism as claimed in claim 1, wherein the rotatable latch comprises a lock portion which engages with a further lock portion external to the rotatable latch, wherein the engagement of the lock portion and further lock portion prevents the rotation of rotatable latch from the latched position to the receiving position.

16. A latch mechanism as claimed in claim 15, wherein the lock portion comprises a lock aperture.

17. A latch mechanism as claimed in claim 15, wherein the further lock portion also prevents the rotation of a further rotational latch.

18. A latch mechanism as claimed in claim 1, wherein the key portions are plates.

19. A latch mechanism as claimed in claim 1, wherein either or both of the first and second key apertures are provided by a v-aperture.

20. A latch mechanism as claimed in claim 19, wherein the first and second key portions comprise a plurality of plate members arranged at an angle to each other.

21. A gate system comprising:

a boom which is rotatably received and restrained by the latch mechanism of claim 1.

22. A gate system as claimed in claim 21, wherein the gate includes two bars, each bar received by a first latch mechanism and a second latch mechanism, each latch mechanism according to claim 1.

* * * * *